US005335050A

United States Patent [19]

Osbourne et al.

[11] Patent Number: 5,335,050

[45] Date of Patent: Aug. 2, 1994

[54] ADJUSTABLE SUPPORT ASSEMBLY

[75] Inventors: William G. Osbourne; Julio A. Sanchez-Banos, both of Webster, N.Y.

[73] Assignee: Xerox Corporation, Stamford, Conn.

[21] Appl. No.: 120,892

[22] Filed: Sep. 13, 1993

[51] Int. Cl.[5] ..... G03G 15/02

[52] U.S. Cl. ..... 355/221; 250/324; 250/325; 361/225

[58] Field of Search ..... 355/219, 221; 361/225, 361/230; 250/324–326

[56] References Cited

U.S. PATENT DOCUMENTS

| | | | |
|---|---|---|---|
| 3,743,830 | 7/1973 | Takahashi et al. | 250/325 |
| 3,800,153 | 3/1974 | Matsumoto et al. | 250/325 |
| 3,908,127 | 9/1975 | Clark | 250/325 |
| 3,919,605 | 11/1975 | Honda | 317/262 |
| 3,922,548 | 11/1975 | Honda | 250/324 |
| 4,252,431 | 2/1981 | Cormier | 355/221 |
| 4,260,240 | 4/1981 | Pieper | 355/221 |
| 4,627,701 | 12/1986 | Onoda et al. | 250/325 X |
| 5,055,878 | 10/1991 | Okamoto et al. | 355/219 |
| 5,142,329 | 8/1992 | Nakaya | 355/221 |

FOREIGN PATENT DOCUMENTS

| | | | |
|---|---|---|---|
| 58-23052 | 2/1983 | Japan | 355/221 |
| 4-18573 | 1/1992 | Japan | 355/221 |

*Primary Examiner*—A. T. Grimley
*Assistant Examiner*—William J. Royer
*Attorney, Agent, or Firm*—Denis A. Robitaille

[57] ABSTRACT

An adjustable support assembly for adjustably supporting a corona generating device at a selected distance from a photoreceptive surface, wherein a fixedly mounted support bracket and an adjustable support bracket are mounted in a cooperatively nested relationship such that reciprocating movement can be affected between the adjustable support bracket and the fixedly mounted support bracket. The adjustable support assembly is provided with support blocks for adjusting the gap between the corona generating device and the photoreceptive surface from a single general location.

16 Claims, 3 Drawing Sheets

ADJUSTABLE SUPPORT ASSEMBLY

The present invention relates generally to an adjustable support assembly, and more particularly concerns an adjustable mounting apparatus for adjustably supporting a corona generating device at a selected distance from a surface to be charged.

As is well known in the art, the process of electrostatographic copying is executed by exposing a light image of an original document to a substantially uniformly charged photoreceptive member. Exposing the charged photoreceptive member to a light image discharges the photoconductive surface thereof in areas corresponding to non-image areas in the original document, while maintaining the charge in image areas to create an electrostatic latent image of the original document on the photoreceptive member. Thereafter, the latent image is developed into a visible image by depositing charged developing material onto the photoreceptive member such that the development particles electrostatically adhere to the photoconductive surface in the charged image areas thereon. This developed image is subsequently transferred to another support surface, and fixed thereto, to generate a permanent copy of the original document. Electrostatographic processes and machines for carrying out these processes are well known and will not be described in detail herein. Numerous printed publications and patents are available in which these details are set forth, as for example: "Electrophotography" by R. M. Schaffert, and "Xerography and Related Processes" by John H. Dessauer and Harold E. Clark, both first published in 1965. These references, and the various patents and other references cited therein, are hereby incorporated by reference herein.

The initial step in the electrostatographic copying process is directed to creating an electrostatic charge on the surface of the photoreceptive member. In this regard, it is critical that the charge imparted to the photoreceptive member be uniform across the photoconductive surface thereof. Irregularities in charge uniformity across the photoconductive surface tends to deteriorate the quality of the final output copy.

This electrostatic charge is generally produced by a corona charging device. Uniformity is generally affected by maintaining the corona generating device at a precise predetermined distance from the surface of the photoreceptive member. More importantly, the maintenance of a precise gap between the corona generating device and the photoreceptive surface directly affects the charge voltage across the corona generating device as well as the electrical life of both the corona generating device and the photoreceptive member. Thus, it is desirable that the apparatus for affecting such charging be adjustably mounted to provide an accurate means for positioning the apparatus at a specified distance from the photoconductive surface. It is also important to provide such adjustability with relative efficiency and simplicity to minimize the amount of time and labor involved in setting proper spatial specifications in a machine.

Thus it is highly desirable to provide an effective, efficient and inexpensive mechanical system for adjusting the spatial distance between a corona generating device and the photoreceptive surface in an electrostatographic machine.

As will be seen from the prior art cited herein below, various apparatus have been disclosed addressing the aforementioned problem. However, one important feature not addressed by the prior art is accessibility to the adjustable mounting assembly. That is, it must be noted that the support assembly of the present invention is typically mounted within a machine where space is at a premium and the means for providing adjustment to the support mechanism is not always convenient or, at a minimum, requires extraordinary dexterity. The present invention provides adjustment means which are particularly well-suited for serviceability and unrestricted access. The following disclosures may be relevant to various aspects of the present invention:

U.S. Pat. No. 3,743,830
Patentee: Takahashi et al.
Issued: Jul. 3, 1973

U.S. Pat. No. 3.800,153
Patentee: Matsumoto et al.
Issued: Mar. 26, 1974

U.S. Pat. No. 3,919,605
Patentee: Honda
Issued: Nov. 11, 1975

U.S. Pat. No. 4,252,431
Patentee: Cormier
Issued: Feb. 24, 1981

U.S. Pat. No. 4,260,240
Patentee: Pieper
Issued: Apr. 7, 1981

U.S. Pat. No. 3,922,548
Patentee: Honda
Issued: Nov. 25, 1975

The relevant portions of the foregoing disclosures may be briefly summarized as follows:

U.S. Pat. No. 3,743,830 discloses a device for uniformly charging a non-planar electrophotographic plate wherein a corona discharge electrode is mechanically coupled to a follower member which is maintained in contact with the non-charging surface of the electrophotographic plate. The distance between the follower member and the discharge electrode is maintained at a constant value as the member moves relative to the discharge electrode such that charge is deposited uniformly over the charging surface of the electrophotographic plate.

U.S. Pat. No. 3,800,153 discloses a fulcrumed charging electrode to accurately space a corona generator wire or wires from a photoconductive surface for charging the same. The corona wire and associated shield are pivoted about and accessed parallel to the wire and several specific means are shown for affecting the desired pivot action and adjustment of the charging electrode.

U.S. Pat. No. 3,919,605 discloses a corona discharge apparatus having an arrangement for easily varying the distance between the discharge device and the photoreceptor surface, the arrangement including a plate spring for biasing the device in one direction and a screw for moving the device against the bias of the plate spring. A supporting rail on which the corona discharge device is slidably mounted is held between flanges on the plate spring.

U.S. Pat. No. 3,922,548 discloses a corona charging device and support arrangement in which the main structure is supported on a rail which is movable vertically toward or away from a supporting base by means of a pair of plate springs adjacent each end of the rail, each spring having one end thereof attached to the supporting base and the other end thereof fixed to the bottom plane of the rail near one end thereof. The supporting rail is movable toward and away from a photosensitive surface by means of a pair of set screws mounted on the supporting base which, when rotated, bear against the bottom of the plate spring and move it and the rail attached thereto in the direction away from the support base and toward a photosensitive surface.

U.S. Pat. No. 4,252,431 discloses an accurately adjustable mount for supporting a corona assembly of a photocopying machine, wherein accurate adjustment of the separation between the corona wires and the photosensitive surface of the photocopying machine is accomplished by separate cam mechanisms located at either end of the corona assembly. Locking means are also provided for securing the corona assembly after the proper separation has been established by the cam mechanisms.

U.S. Pat. No. 4,260,240 discloses an electrostatic copier including a carrier to which a corona discharge device is fixed. The electrostatic copier is further provided with a slide member supporting the carrier and with respect to which the carrier is movable between two end positions for setting the distance between the corona discharge device and the surface of the recording material.

In accordance with the present invention, an apparatus for adjustably supporting a device at a precise selected distance from a surface is provided, comprising: a fixedly mounted support bracket having an elongated body along a longitudinal axis, including a pair of opposed lateral sidewalls and an endcap transverse thereto, wherein the lateral sidewalls include complementary elongated support slots positioned in alignment with one another on each sidewall; an adjustable support bracket having an elongated body for being mounted in a nestable configuration with the fixedly mounted support bracket, including a pair of opposed lateral sidewalls and complementary adjustment slots positioned in alignment with one another on each sidewall; coupling means having integral support projections extending outwardly therefrom for cooperative engagement with the complementary support slots and the complementary adjustment slots; and means for adjustably positioning the coupling means along the longitudinal axis for effecting selective reciprocating movement of the adjustable support bracket relative to the fixedly mounted support bracket.

In accordance with a particular aspect of the invention, a corona generating device is provided with an adjustable support assembly for adjustably supporting the corona generating device to establish a gap between the corona generating device and a photoconductive surface. The adjustable support assembly comprises: a fixedly mounted support bracket having an elongated body along a longitudinal axis, including a pair of opposed lateral sidewalls and an endcap transverse thereto, wherein the lateral sidewalls include complementary elongated support slots positioned in alignment with one another on each sidewall; an adjustable support bracket having an elongated body for being mounted in a nestable configuration with the fixedly mounted support bracket, including a pair of opposed lateral sidewalls and complementary adjustment slots positioned in alignment with one another on each sidewall; a coupling means having support projections extending outwardly therefrom for cooperative engagement with the complementary support slots and the complementary adjustment slots; and means for adjustably positioning the coupling means along the longitudinal axis for effecting selective reciprocating movement between the adjustable support bracket and the fixedly mounted support bracket.

In accordance with yet another aspect of the invention, an electrostatographic printing apparatus is provided with an adjustable support assembly for adjustably supporting a corona generating device at a precise selected distance from a photoconductive surface. The adjustable support assembly comprises: fixedly mounted support means having an elongated body along a longitudinal axis, including, a pair of opposed lateral sidewalls and an end cap transverse thereto, wherein the lateral sidewalls include complementary elongated support slots positioned in alignment with one another on each sidewall; adjustable support means having an elongated body for being mounted in a nestable configuration with the fixedly mounted support means, including a pair of opposed lateral sidewalls and complementary adjustment slots positioned in alignment with one another on each sidewall; coupling means having support projections extending outwardly therefrom for cooperative engagement with the complementary support slots and the complementary adjustment slots; and means for adjustably positioning the coupling means along the longitudinal axis for effecting selective reciprocating movement of the adjustable support means relative to the fixedly mounted support means.

These and other aspects of the present invention will become apparent from the following description in conjunction with the accompanying drawings in which.

Figure 1:
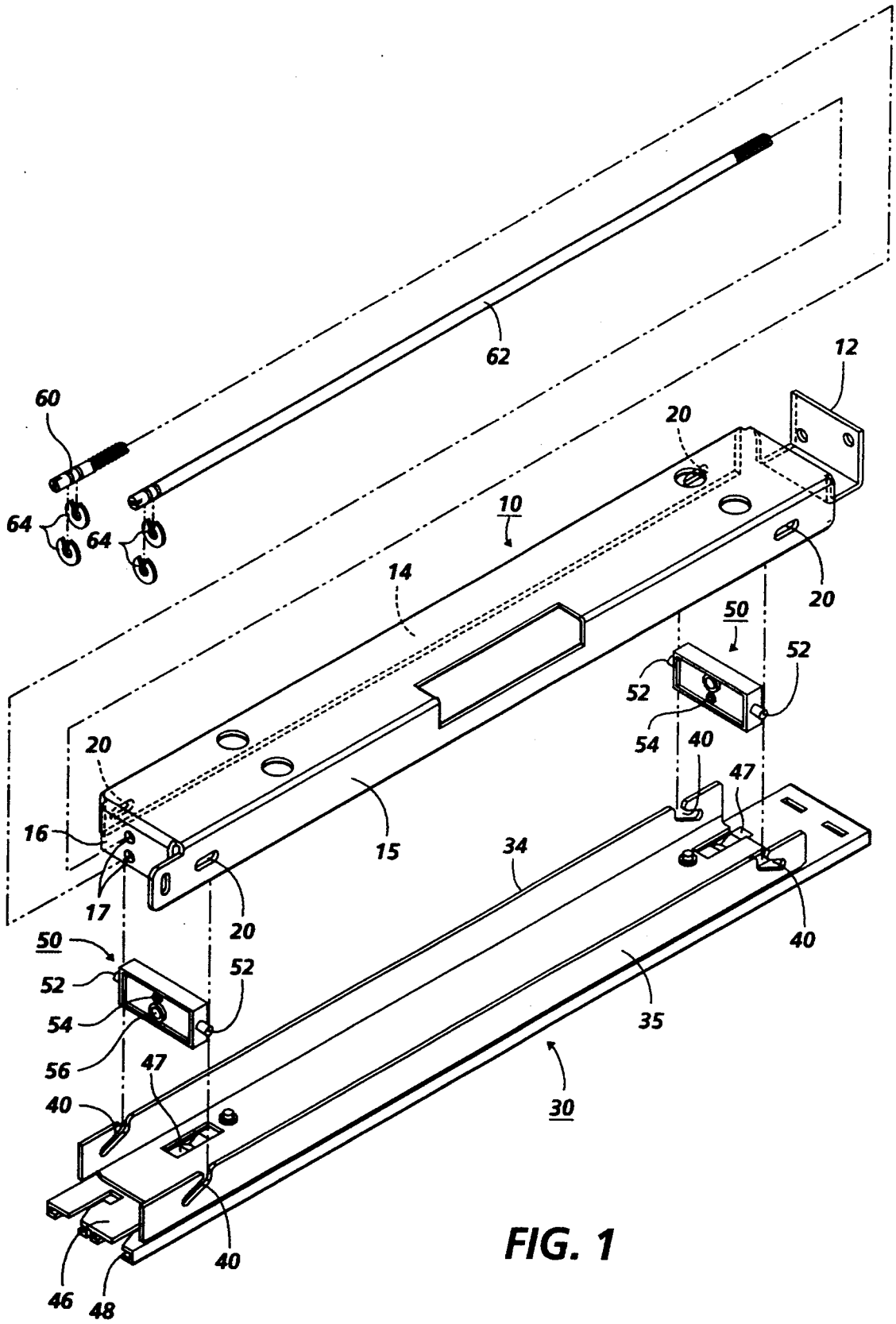
FIG. 1 is an exploded perspective view of the adjustable support assembly of the present invention.

For a general understanding of the features of the present invention, reference is made to the drawings, wherein like reference numerals have been used throughout to designate corresponding elements of a preferred embodiment. While the present invention will be described in terms of a specific preferred embodiment, it will be understood that the invention is not to be limited to this preferred embodiment. For example, although the present description is directed toward a mounting device for use in an electrostatographic machine, the use should not be limited to such environment. On the contrary, the present invention is intended to cover all alternatives, modifications, and equivalents as may be included within the spirit and scope of the invention as defined by the appended claims.

Referring initially to FIG. 1, a perspective exploded depiction of the various components of an adjustable support assembly in accordance with the present invention is provided. As seen in FIG. 1, the adjustable support assembly of the present invention is generally comprised of two nested mounting brackets 10, 30 and a pair of support blocks so slidably mounted therebetween. Each component of the support assembly will be described individually hereinbelow.

The adjustable support assembly includes a first support piece or, so-called fixedly mounted support bracket 10, having a mounting bracket 12 for fixedly mounting the support bracket in a stationary configuration, as for example, on a column or other frame member in an electrostatographic machine (not shown). The fixedly mounted support bracket 10 has an elongated body including a pair of opposed lateral sidewalls 14, 15 and an end cap 16 located opposite the mounting plate 12. Each lateral sidewall 14, 15 is provided with a pair of complementary elongated support slots 20 located adjacent either end of the elongated body of the fixedly mounted support bracket, namely adjacent the mounting plate 12 and the end cap 16. The complementary elongated support slots 20 are positioned in alignment with one another on each sidewall in a plane parallel to the longitudinal axis of the elongated body, for receiving support projections as will be described.

Figure 2:
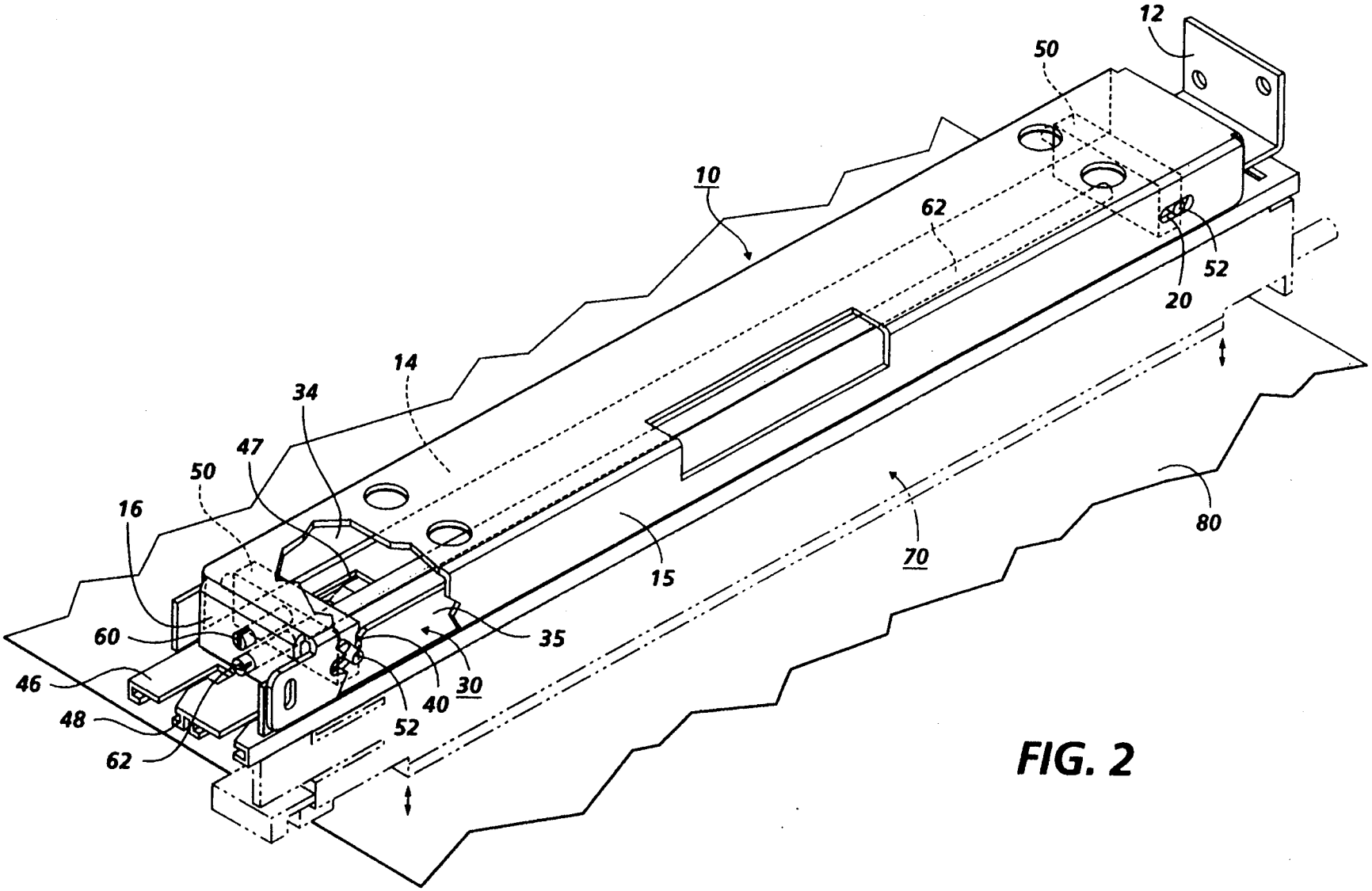
FIG. 2 is a partially cross-sectional perspective view of the adjustable support assembly of FIG. 1 shown in its operating configuration.

A second support piece, so-called adjustable support bracket 30 is also provided for being nested in, and preferably adjustably mounted to, the fixedly mounted support bracket 10. The adjustable support bracket 30 includes an elongated body having a pair of opposed lateral sidewalls 34 and 35 for being juxtaposed adjacent the lateral sidewalls 14, 15 of the fixedly mounted support bracket 10. Lateral sidewalls 34, 35 of the adjustable support bracket 30 also include a pair of complementary elongated support slots 40 located adjacent the ends of the elongated body of the adjustable support bracket 30. The complementary adjustment slots 40 are situated on an inclined plane relative to the elongated body, and are preferably on opposite inclined planes, as shown. The adjustable alignment slots 40 are positioned at either end of the elongated body so as to be in substant alignment with the elongated support slots 20 of fixedly mounted support bracket 10 when the adjustable support bracket 30 is nested therein. The adjustable support bracket 30 also includes a mounting plate 46 for receiving a device which is to be supported by the support assembly. In the illustrative embodiment, the mounting plate 46 includes a receiving channel 48 for receiving a typical corona generating device 70, as shown in FIG. 2 wherein the corona charging device is slidably mounted in the receiving channel 48 and is removably locked into position therein by means of locking clips 47. Preferably, the locking clips 47 include a leaf spring member for pressing against the corona generating device 70 while supported in the mounting plate 46 so as to provide the additional function of preventing any vibration of the corona generating device 70, thereby enhancing the uniformity of the charge generated thereby.

A pair of support blocks 50 are also provided, being generally designed to be disposed between the fixedly mounted support bracket 10 and the adjustable support bracket 30 when nested together. Each support block 50 is substantially identical, including integral support projections 52 extending generally perpendicularly therefrom on opposite sides for cooperative engagement with the elongated adjustment slots 40 of the adjustable support bracket 30 as well as the elongated support slots 20 of the fixedly mounted support bracket 10. The support blocks 50 operate to interactively couple and securely engage the adjustable support bracket 30 with the fixedly mounted support bracket 10 when nested together with the integral support projections 52 thereof extending through the lateral sidewalls of the adjustable support bracket 30 and the fixedly mounted support bracket 10, within the complementary adjustment slots and support slots thereof, respectively.

The adjustable support assembly of the present invention also includes a pair of threaded shafts 60 and 62, each cooperative with a support block 50, for adjustably positioning the respective support block along the longitudinal axis of the elongated body of the support assembly. Each threaded shaft 60, 62 is mounted to end cap 16 through receiving apertures 17 via locking clips 64 such that the threaded shaft 60, 62 can be rotated to allow the threads thereof to mesh with a threaded aperture 54 in each respective support block 50. It will be seen from FIG. 1 that the support block closest to end cap 16 is provided with a receiving aperture 56 for permitting threaded rod 62 to extend to the opposite support block.

Figure 3:
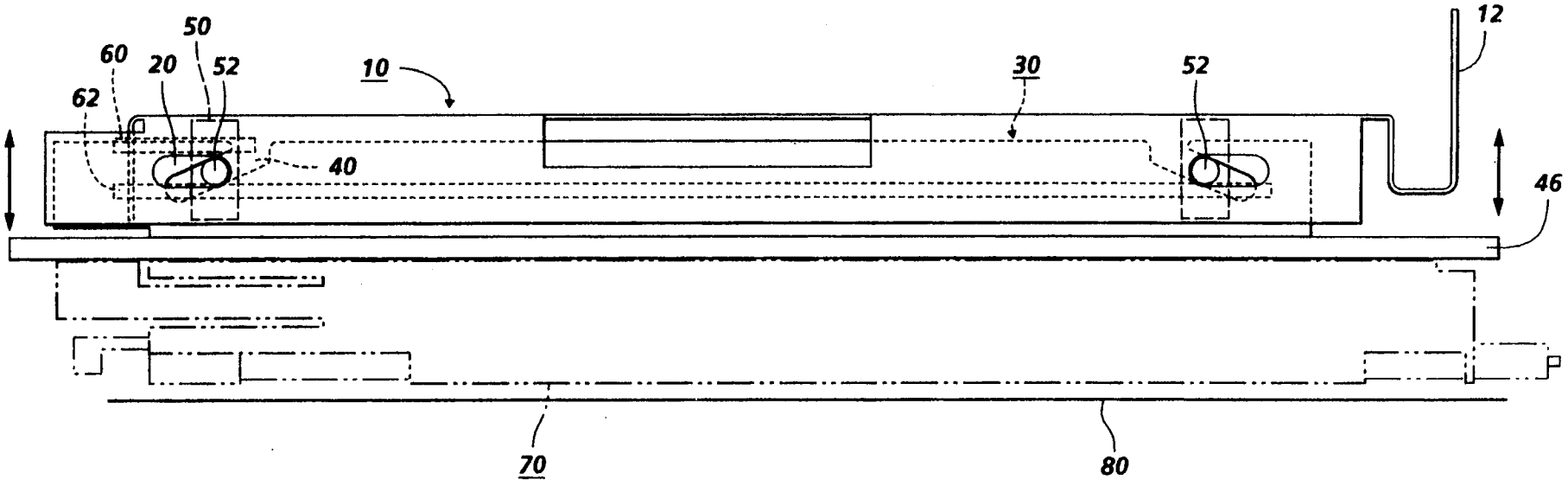
FIG. 3 is a side view of the adjustable support assembly of the present invention.

Now that each of the components of the present invention have been described in detail, a description of the entire adjustable support assembly will now be provided with additional reference to FIGS. 2 and 3 which show the adjustable support assembly with the fixedly mounted support bracket 10 and the adjustable support bracket 30 positioned in a nested configuration. As can be seen, support blocks 50 lie between the adjustable support bracket 30 and the fixed support bracket 10 with the support projections 52 of each support block extending through the complementary elongated support slots and the complementary adjustment slots of each support bracket, respectively. The support blocks are adjustably positionable within the nested support brackets along the longitudinal axis thereof by means of threaded rods 60 and 62. The movement of the support blocks is constrained to a plane parallel to the longitudinal axis by the presence of the support projection in the elongated support slots 20 of the fixedly mounted support bracket 10. Thus, the support blocks can move only on a plane parallel to the longitudinal axis relative to the elongated body of the adjustable support assembly. It is this feature that provides reciprocating movement of the adjustable support bracket 30 relative to the fixedly mounted support bracket 10, and thus relative to a surface, such as photoreceptive surface 80, adjacent to the assembly of the present invention.

Adjustability of the adjustable support bracket is accomplished by varying the position of the support blocks 50 along the longitudinal axis. Displacement of the support blocks 50, generates a cooperative interaction between the support projections 52, the elongated support slots 20 of the fixedly mounted support bracket 10 and the elongated adjustment slots 40 of the adjustable support bracket 30. As previously described, the elongated support slots 20 of the fixedly mounted support bracket 10 serve to constrain the movement of the support projections 52 to a plane parallel to the longitudinal axis of the assembly. Meanwhile, support projections 52 also travel within the complementary adjustment slots 40 of adjustable support means 30. Owing to the fact that the complementary adjustment slots lie in an inclined plane relative to the longitudinal axis of the assembly, the displacement of the support projection causes the adjustable support bracket 30 to be displaced in a plane perpendicular to the longitudinal axis of the elongated body.

An important feature of the present invention lies in the fact that adjustment at either end of the elongated body can be provided from a common general location. That is, as will be recognized from FIG. 2, adjustment to either support block can be facilitated by access to the end cap 16 of the fixedly mounted support bracket 10 where both threaded shaft 60, coupled to the outboard support block, and threaded shaft 62, coupled to the inboard support block, are both accessible. To prevent confusion in adjusting the height level of both the inboard and outboard blocks, threaded shafts 60 and 62 are provided with opposite threads such that rotation of either screw in the same direction has the same effect of either raising or lowering the adjustable support bracket 30 relative to the fixedly mounting bracket 10. Thus, like rotation of each threaded shaft results in like reciprocating movement between the adjustable support bracket and the fixedly mounted support bracket.

In recapitulation, it should be clear from the foregoing discussion that the apparatus of the present invention provides a novel adjustable support assembly wherein a corona generating device or any other device can be adjustably supported at a selected distance from a surface. The adjustable support assembly comprises a fixedly mounted support bracket and an adjustable support bracket coupled together in a nesting relationship wherein reciprocating movement of the adjustable support bracket relative to the fixedly mounted support bracket is affected by means of a pair of adjustably positionable support blocks including integral support projections interacting with support slots and adjustment slots in the fixedly mounted support bracket and the adjustable support bracket, respectively. The support blocks are preferably adjustably positionable from a single reference position.

It is, therefore, apparent that there has been provided, in accordance with the present invention, a corona generating assembly that fully satisfies the aims and advantages set forth hereinabove. While the present invention has been described in conjunction with a specific embodiment thereof, it will be evident to those skilled in the art that many alternatives, modifications and variations are possible to achieve the desired results. Accordingly the present invention is intended to embrace all such alternatives, modifications, and variations which may fall within the spirit and scope of the following claims.

We claim:

1. An apparatus for adjustably supporting a device at a precise selected distance from a surface, comprising:

a fixedly mounted support bracket having an elongated body extending along a longitudinal axis, including opposed lateral sidewalls and an end cap transverse thereto, said lateral sidewalls having complementary elongated support slots positioned in alignment with one another on each sidewall;

an adjustable support bracket having an elongated body for being mounted in a nestable configuration with said fixedly mounted support bracket, including opposed lateral sidewalls having complementary adjustment slots positioned in alignment with one another on each sidewall;

coupling means having integral support projections extending outwardly therefrom for cooperative engagement with the complementary support slots and the complementary adjustment slots to interactively couple said adjustable support bracket to said fixedly mounted support bracket; and means for adjustably positioning said coupling means along the longitudinal axis for effecting selective reciprocating movement of said adjustable support bracket relative to said fixedly mounted support bracket.

2. The apparatus of claim 1, wherein:

said coupling means includes first and second support blocks, each including a threaded aperture; and said adjustable positioning means includes first and second threaded shafts, each being respectively cooperative with said first and second support blocks via the threaded aperture thereof, for positioning each said support block along the longitudinal axis to effect precise reciprocating movement of said adjustable support bracket relative to said fixedly mounted support bracket.

3. The apparatus of claim 2, wherein said first and second threaded shafts are rotatably connected to said end cap for providing adjustable access thereto from a common general location.

4. The apparatus of claim 1, wherein said adjustable support bracket includes a mounting plate for receiving the device to be supported by said apparatus.

5. The apparatus of claim 4, wherein said mounting plate includes a locking member for locking engagement with the device received by said mounting plate.

6. The apparatus of claim 1, wherein said fixedly mounted support bracket includes a mounting bracket located opposite said end cap for fixedly mounting said apparatus to an external fixture.

7. A corona generating device, including an adjustable support assembly for adjustably supporting the corona generating device to selectively establish a gap between the corona generating device and a photoconductive surface, comprising:

a fixedly mounted support bracket having an elongated body extending along a longitudinal axis, including opposed lateral sidewalls and an end cap transverse thereto, said lateral sidewalls having complementary elongated support slots positioned in alignment with one another on each sidewall;

an adjustable support bracket having an elongated body for being mounted in a nestable configuration with said fixedly mounted support bracket, including opposed lateral sidewalls having complementary adjustment slots positioned in alignment with one another on each sidewall;

coupling means having integral support projections extending outwardly therefrom for cooperative engagement with the complementary support slots and the complementary adjustment slots to interactively couple said adjustable support bracket to said fixedly mounted support bracket; and means for adjustably positioning said coupling means along the longitudinal axis for effecting selective reciprocating movement between said adjustable support bracket and said fixedly mounted support bracket.

8. The corona generating device of claim 7, wherein:

said coupling means includes first and second support blocks, each including a threaded aperture; and said adjustable positioning means includes first and second threaded shafts, each being respectively cooperative with said first and second support blocks via the threaded aperture thereof, for positioning each said support block along the longitudinal axis to effect precise reciprocating movement of said adjustable support bracket relative to said fixedly mounted support bracket.

9. The corona generating device of claim 8, wherein said first and second threaded shafts are rotatably connected to said end cap for providing adjustment thereto from a common general location.

10. The corona generating device of claim 9, wherein said adjustable support bracket includes means for releasably mounting said corona generating device on the adjustable support assembly.

11. The corona generating device of claim 10, wherein said releasable mounting means includes means for locking engagement with said corona generating device.

12. An electrostatographic printing apparatus including an adjustable support assembly for adjustably supporting a corona generating device at a precise selected distance from a photoconductive surface, comprising:

fixedly mounted support means having an elongated body extending along a longitudinal axis, including opposed lateral sidewalls and an end cap transverse thereto, said lateral sidewalls having complementary elongated support slots positioned in alignment with one another on each sidewall;

adjustable support means having an elongated body for being mounted in a nestable configuration with said fixedly mounted support means, including opposed lateral sidewalls having complementary adjustment slots positioned in alignment with one another on each sidewall;

coupling means having integral support projections extending outwardly therefrom for cooperative engagement with the complementary support slots and the complementary adjustment slots to interactively couple said adjustable support means to said fixedly mounted support means; and means for adjustably positioning said coupling means along the longitudinal axis for effecting selective reciprocating movement of said adjustable support means relative to said fixedly mounted support means.

13. The electrostatographic printing apparatus of claim 12, wherein:

said coupling means includes first and second support blocks, each including a threaded aperture; and said adjustable positioning means includes first and second threaded shafts, each being respectively cooperative with said first and second support blocks via the threaded aperture thereof, for positioning each said support block along the longitudinal axis to effect precise reciprocating movement of said adjustable support means relative to said fixedly mounted support means.

14. The electrostatographic printing apparatus of claim 13, wherein said first and second threaded shafts are rotatably connected to said end cap for providing access thereto from a common general location.

15. The electrostatographic printing apparatus of claim 12, wherein said adjustable support means includes means for releasably mounting said corona generating device on said adjustable support assembly.

16. The electrostatographic printing apparatus of claim 15, wherein said releasable mounting means includes means for locking engagement with said corona generating device.

* * * * *